US005532811A

United States Patent [19]

Nishikawa et al.

[11] Patent Number: 5,532,811

[45] Date of Patent: Jul. 2, 1996

[54] SHEET FEED MECHANISM WITH CONTROL FOR ADVANCEMENT AND RETRACTION OF PAPER

[75] Inventors: Tomoyuki Nishikawa; Yoshimi Saito, both of Tokyo, Japan

[73] Assignee: Asahi Kogaku Kogyo Kabushiki Kaisha, Tokyo, Japan

[21] Appl. No.: 267,245

[22] Filed: Jun. 29, 1994

[30] Foreign Application Priority Data

Jun. 30, 1993 [JP] Japan ..... 5-186810

[51] Int. Cl.[6] ..... G03G 21/00

[52] U.S. Cl. ..... 355/316; 355/309

[58] Field of Search ..... 355/309, 313, 355/316

[56] References Cited

U.S. PATENT DOCUMENTS

| | | | |
|---|---|---|---|
| 3,856,128 | 12/1974 | Taggart | 226/32 X |
| 4,264,200 | 4/1981 | Tickner et al. | 355/309 X |
| 4,478,508 | 10/1984 | Kato et al. | 355/317 |
| 4,943,863 | 7/1990 | Ainoya | 355/309 X |
| 5,019,872 | 5/1991 | Zajac, Jr. | 355/317 |
| 5,061,967 | 10/1991 | Isobe | 355/310 |
| 5,063,416 | 11/1991 | Honda et al. | 355/316 |
| 5,111,248 | 5/1992 | Kita et al. | 355/308 X |
| 5,115,493 | 5/1992 | Jeanblanc et al. | 395/117 |
| 5,194,903 | 3/1993 | Negishi et al. | 355/316 |
| 5,210,583 | 5/1993 | Monma | 355/309 |

FOREIGN PATENT DOCUMENTS 62-233276 10/1987 Japan .

OTHER PUBLICATIONS

Partial English translation of JP 62–233276.

*Primary Examiner*—Fred L. Braun

*Attorney, Agent, or Firm*—Greenblum & Bernstein

[57] ABSTRACT

A sheet feed mechanism for an electrophotographic printer employing continuous fan-fold paper may be controlled between multiple operational modes. Following image formation on each page, the sheet feed may be stopped or advanced and then stopped. A desired mode is selected depending on whether the user desires to print more than one page successively or to separate printed pages. The sheet feed mechanism ensures that the printer does not needlessly advance the continuous sheet when there are pauses in data transmission or other pauses.

11 Claims, 7 Drawing Sheets

SHEET FEED MECHANISM WITH CONTROL FOR ADVANCEMENT AND RETRACTION OF PAPER

BACKGROUND OF THE INVENTION

A conventionally known electrophotographic device may employ so called fan-fold paper, which is a foldable continuous recording sheet having sprocket holes along each edge. Succeeding discrete pages along the fan-fold sheet may be separated at perforations between each page.

Conventional continuous sheet feed mechanism have several problems. If pages are discharged from the printer body when printed, or when there is a pause in data transmission, gaper is wasted as each page or job is discharged, end each discharge introducing a printing delay before printing of the next page or job is possible. Conversely, pages kept inside the printer body are inaccessible to a user. There is therefore a need for a continuous sheet feed mechanism for an electrophotographic printer that may effectively solve 811 the problems of paper waste, printing delay, and paper inaccessibility. However, the appropriate sheet feed operation to solve one problem may not be appropriate for another problem.

SUMMARY OF THE INVENTION

It is therefore an object of the present invention to provide a sheet feed mechanism capable of selecting an appropriate discharge operation mode from a set of possible modes.

The improved sheet feed mechanism comprises a sheet path, a feeding device capable of advancing and retracting a sheet along the sheet path, a sheet feed controller, having several operation modes that regulates the operation of the feeding device according to a selected operation mode, and a mechanism for selecting the operation mode. The controller is able to select from at least: a first mode, wherein the sheet is stopped along the sheet path after a completed image transfer; and a second mode, wherein the sheet is advanced along the sheet path after a completed image transfer and is then stopped, so that the portion of the continuous sheet carrying the printed image is discharged from the printer body.

Optionally, the control system may be able to select a third mode, wherein the sheet is advanced along the sheet path after a completed image transfer and is then stopped, so that the portion of the continuous sheet carrying the printed image is discharged from the printer body, and when the next printing data is received by the printer, the continuous sheet is retracted into said printer body to an appropriate position to print a succeeding image.

The mechanism may further comprise a rewritable memory, which holds information representing a desired operational mode, and a mechanism of changing the information in the memory, wherein the controller is capable of reading from and writing to the memory, and of changing the operation of the feeding device based on the information in the rewritable memory.

DESCRIPTION OF THE ACCOMPANYING DRAWINGS

Figure 3A:
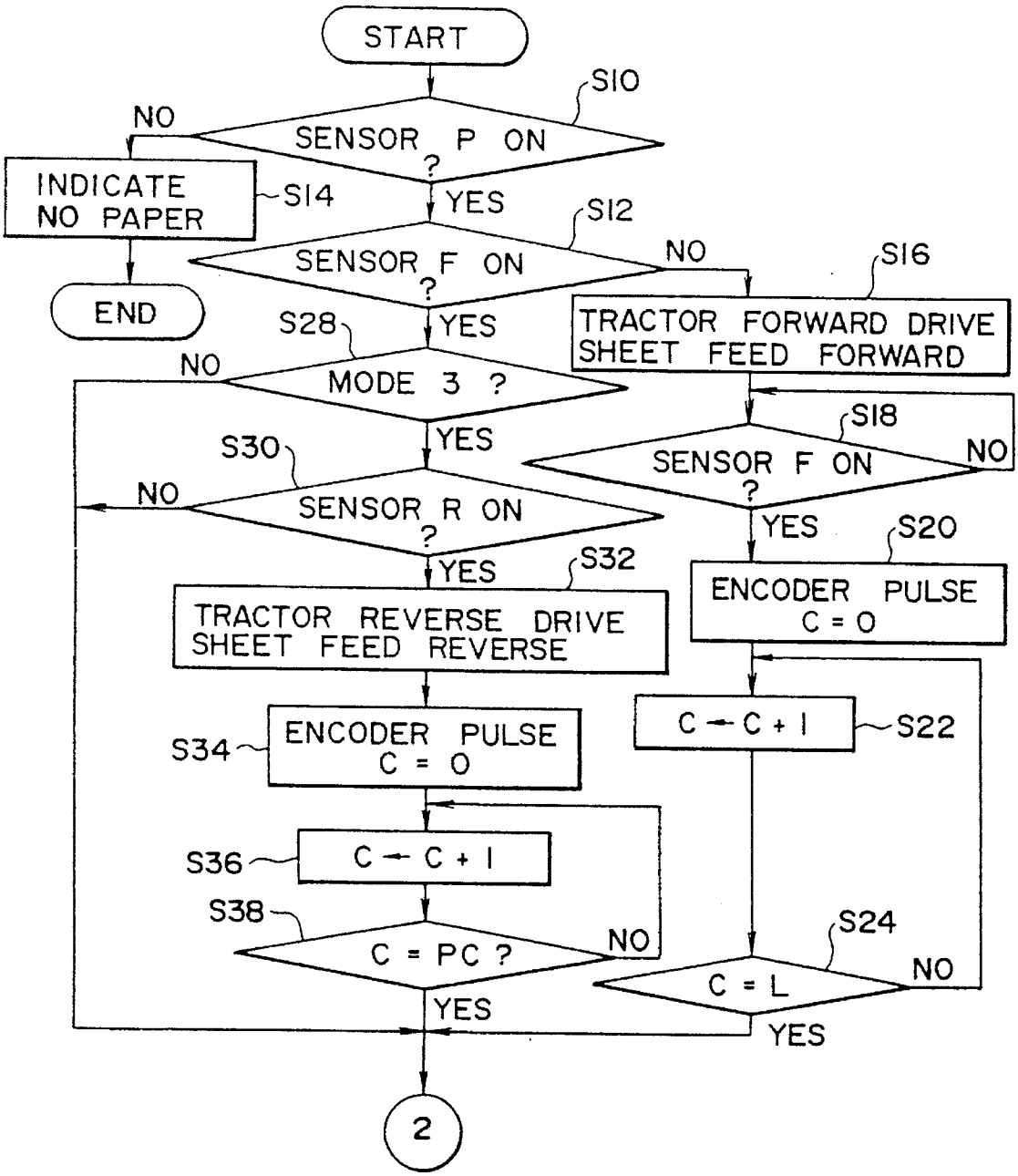
Figure 3:
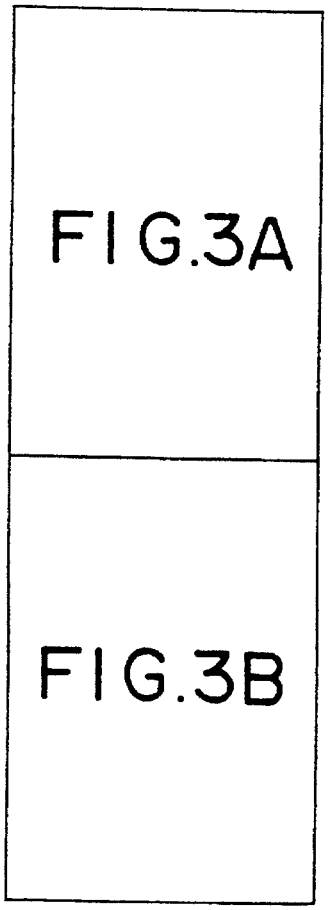

Figs. 3 (comprising FIGS. 3A and 3B) and 4 are flow charts showing the steps executed to control an embodiment of the sheet feed mechanism of the present invention.

FIG. 5, 6, 7, and 8 illustrate paper feed states.

DESCRIPTION OF THE EMBODIMENT

With reference to the drawings, an embodiment of the present invention is described.

Figure 1:
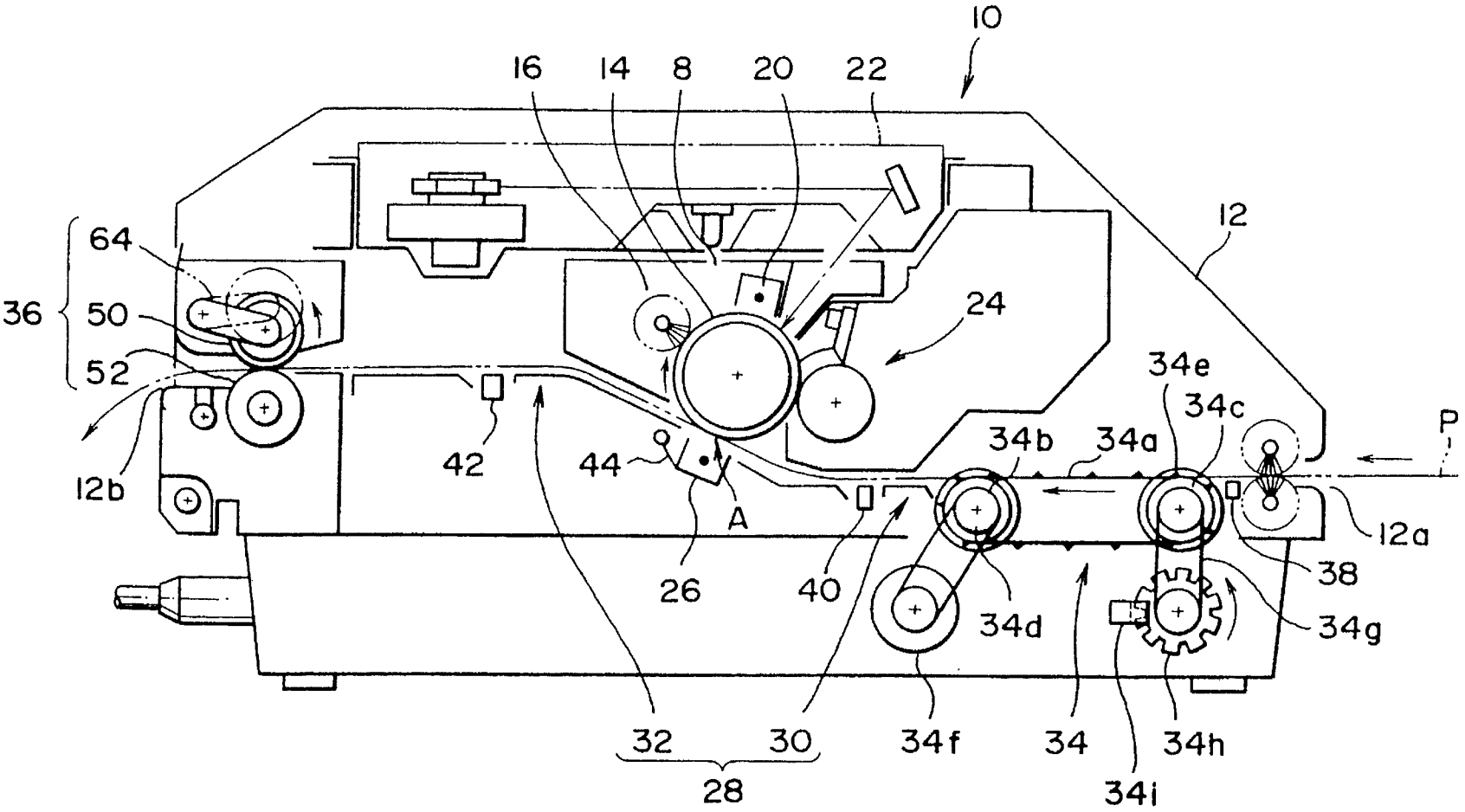
Fig. 1 is a schematic view of a continuous paper laser printer employing an embodiment of the sheet feed mechanism of the present invention.

As shown in FIG. 1, in a laser beam printer 10, an image transmitted from an external device such as a computer may be printed on a continuous fan-fold sheet P. The printer 10 comprises a main body 12, in which a photoconductive drum 14 is rotatably mounted. The photoconductive drum 14 is driven to rotate at a predetermined rotational speed by a main motor (not shown). The elements of the image formation apparatus are arranged around the drum 14 in clockwise order as follows : a toner cleaning unit 16 for removing toner remaining on the photoconductive surface of the drum 14, a discharging unit (not shown) for removing the charge on the photoconductive drum 14, a charging unit 20 for uniformly charging the photoconductive surface of the drum 14, a laser scanning unit 22 for selectively applying a laser beam to the surface of the drum 14, a developing unit 24 for applying toner to a latent image formed on the drum 14 by the laser scanning unit 22, and a transfer charger 26 for transferring a toner image on the drum 14 onto the fan-fold sheet P. As shown, the clockwise direction is the rotational direction of the transfer drum 14.

In the schematic shown in Fig, 1, a sheet feed path 28 extends from right to left in the main body 12. The fan-fold sheet P is directed along sheet feed path 28 through a transfer region A, defined between the drum 14 and the transfer charger 26. The sheet feed path comprises an entry path 30 and a discharge path 32, respectively upstream and downstream of the transfer region A, Along the entry path 30, a tractor 34 is positioned. The tractor 34 may feed the sheet P into the main body 12 through sheet inlet 12*a*, or retract a discharged portion of sheet P through sheet outlet 12*b*. A fixing unit 36 is positioned along the discharge path 32.

First sheet detector 38 (sensor P) and second sheet detector 40 (sensor F) are arranged along the entry path 30, positioned respectively between the sheet inlet 12*a* and the tractor 41, and between the tractor 34 and the drum 14. Third sheet detector 42 (sensor R) is positioned along the discharge path 32, between the drum 14 and the fixing unit 36.

In a laser printer 10 as described above, a latent image is formed on the photoconductive surface of the drum 14 when the laser scanning unit 22 scans the drum 14 with a laser beam. To form the latent image, the laser beam scans the drum 14 in the axial direction (principal scanning) while the drum 14 is rotated (auxiliary scanning). Toner is then applied to the latent image by the developing unit 24 to form a toner image on the drum 14. As the sheet is fed along the sheet feed path 28 by the tractor 34, the toner image is transferred to the sheet P by the transfer charger 26. The toner image is fixed onto the sheet P by the fixing unit 36, and the sheet P may then be discharged from the main body 12.

The tractor 34 comprises a pair of endless tractor belts 34*a*, 34*a*, on either lateral side of the sheet feed path 28, which extend between downstream feed roller 34*b* and upstream feed roller 34*c*. The downstream and upstream feed rollers 34*b* and 34*c* are rotated about shafts 34*d* and 34*e* respectively, such that the tractor belts 34A circulate in a direction corresponding to sheet advancement or retraction. Each tractor belt 34*a* is provided with a plurality of protrusions, arranged along the belt in the direction of belt circulation. The protrusions are evenly spaced at a interval corresponding to a plurality of sprocket holes in the longitudinal direction of fan-fold sheet P. The interval in this embodiment is ½ inch.

The downstream feed roller shaft 34*d* is connected to a driving motor 34*f* for forward and reverse rotation. Depending on the direction of rotation of motor 34*f*, the feeding direction of the sheet is changed.

The upstream feed roller shaft 34*e* is connected to an encoder 34*h* via an endless belt 34*g*. A number of slits are evenly spaced radially in the rotational direction of the encoder, the number of slits corresponding to the number of protrusions on belt 34*a*. A photo-interrupter 34*i* is positioned such that the slits of the encoder 34*h* sequentially pass through the photo-interrupter when the encoder 34*h* rotates. As the encoder 34*h* rotates synchronously with the circulation of tractor belt 34*a*, pulses are generated by the photo-interrupter 34*i* corresponding to the passing of the slits in the encoder 34*h*. The speed or distance of sheet feed may be detected by detecting the pulses generated by the photo-interruptor 34*i*.

The transfer charger 26 is supported by an arm 44. The arm 44 is swung by a swinging mechanism (not shown) to move the charger 26 between operative and retracted positions, i.e., toward and away from the drum 14.

The fixing device comprises a heat roller 50 and a press roller 52, opposedly arranged. The heat roller 50 is supported by a holding arm 64. The holding arm 64 is swung by a swinging mechanism (not show) to move the heat roller 50 between operative and retracted positions, i.e. toward and away from the press roller 52.

The sheet feed distance between the transfer position and the fixing position is set to be shorter than the shortest discrete page length, separable at perforation in the continuous fan-fold sheet, of the various page sizes of continuous fan-fold sheet employable in the printer 10.

Figure 2:
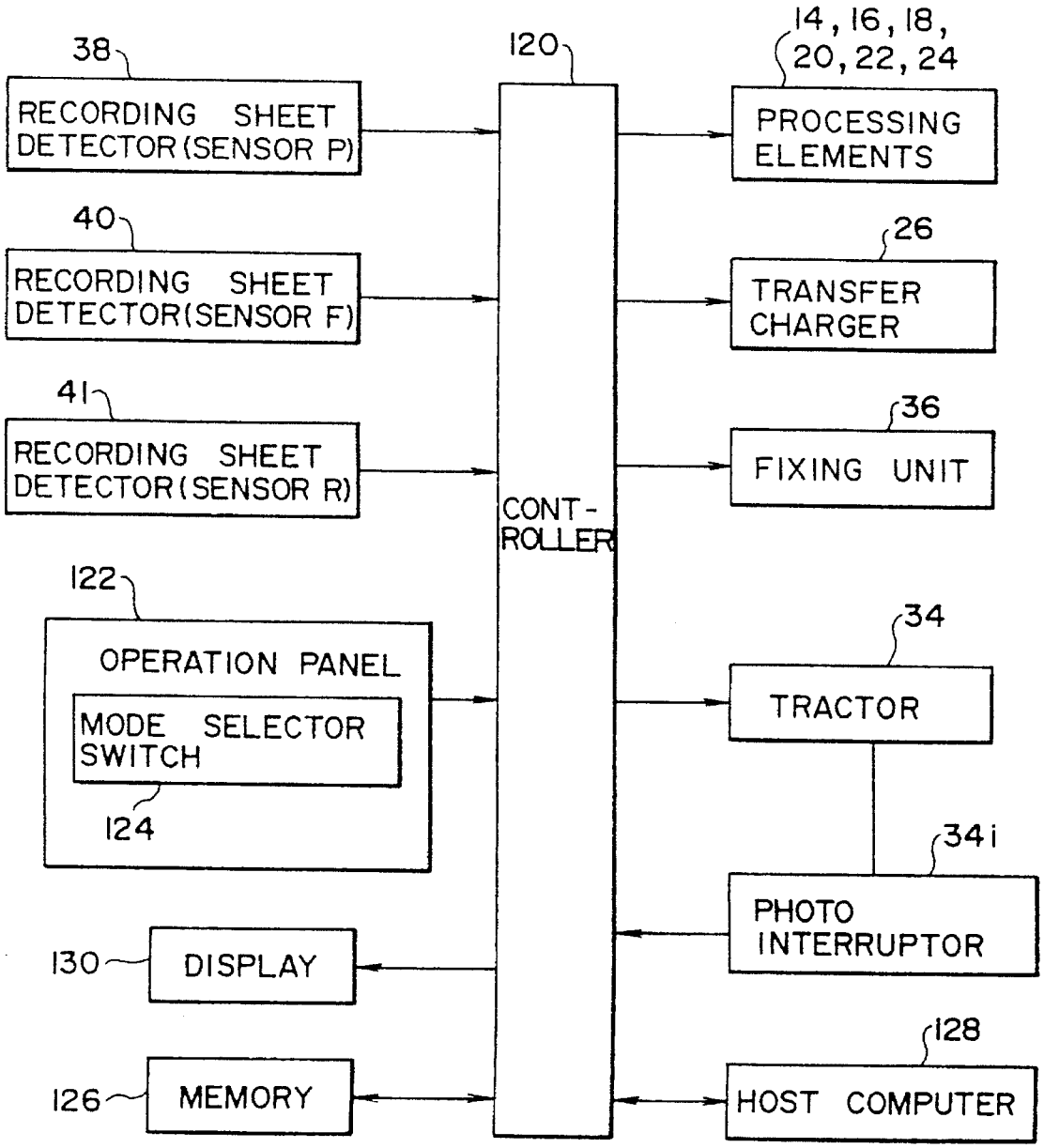
FIG. 2 is a block diagram of a controller used to control the operation of a laser printer of the type shown in FIG. 1.

FIG. 2 shows a controller 120 for controlling the operations of a laser beam printer 10.

Inputs to the controller 120 include, data from the photo-interruptor 34*i*, generated by the rotation of the encoder 34*h* synchronously rotating with the tractor 34; sheet detecting data from the recording sheet detectors 38, 40, and 42; operation data from the operation panel 122; and image data and operation data from the host computer 128. The control panel includes a manual mode selector switch 124 for changing the sheet feed mode among: a first mode, wherein the sheet is stopped along the sheet path after a completed image transfer; a second mode, wherein the sheet is advance along the sheet path after a completed image transfer and then stopped, so that the portion of the continuous sheet carrying the printed image is discharged from the printer body. The selector switch 12 may optionally select a third mode, wherein the sheet is advanced and stopped as in the second mode, and when the next set of printing data is received, is retracted into the printer body and stopped at the appropriate position to print a succeeding image.

The controller 120 is provided with a rewritable static memory 126, and various data such as the sheet size, communication protocol, number of print cycles, and the sheet feeding mode may be stored therein.

The controller 120 controls operations of the printer 10, based on the input data, so as to depict the image transferred from the host computer 128 and saved in a page memory (not shown). The host computer may also send operational commands to change some of the data stored in the rewritable static memory 126. Numeral 130 represents a display such as an LCD panel, wherein various information Such as error information, a selected sheet feed mode, or other information stored in the memory 126 may be viewed.

Figure 3B:
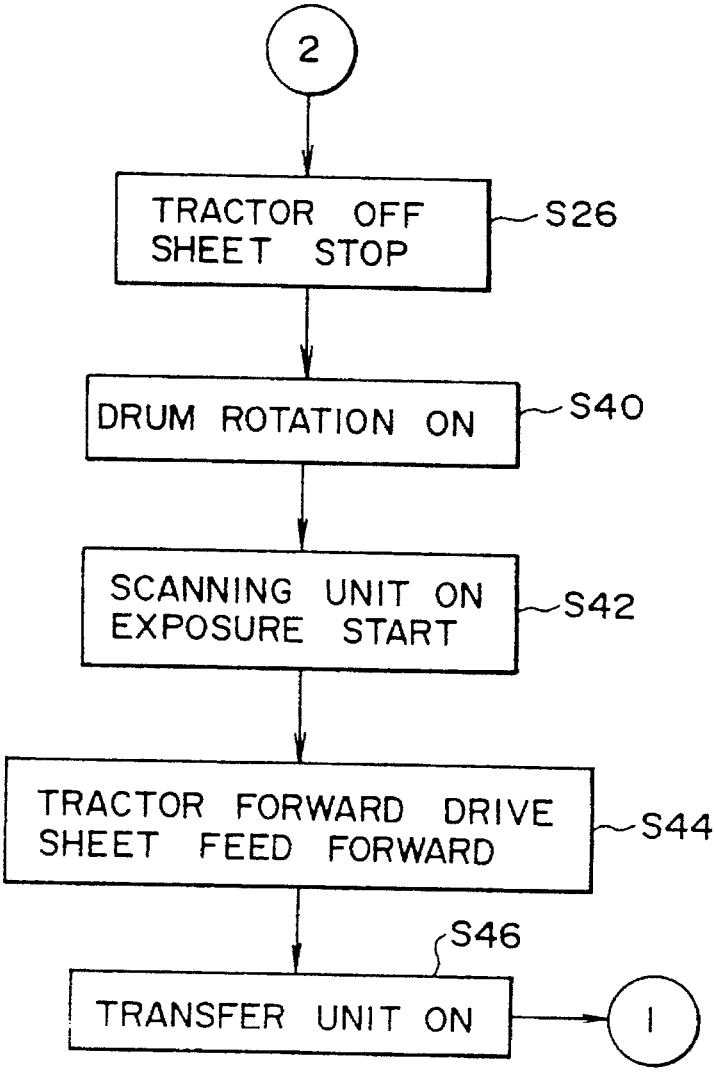

Referring to the flow charts illustrated in FIGS. 3A, 3B, and 4, the print control steps executed by the controller 120 are hereinafter explained.

First, at S10 and S12, the current feeding status of the sheet P is checked, based upon the detected data from the sheet detectors 38 and 40 (sensors P and F respectively). At this stage, the transfer charger 26 and the heat roller 50 of the fixing unit 36 are at their retracted (inoperative) positions. If the sheet P is not detected at S10, then a "No Paper" message is sent to the display 130 at S14, and the print cycle ends.

Figure 5:
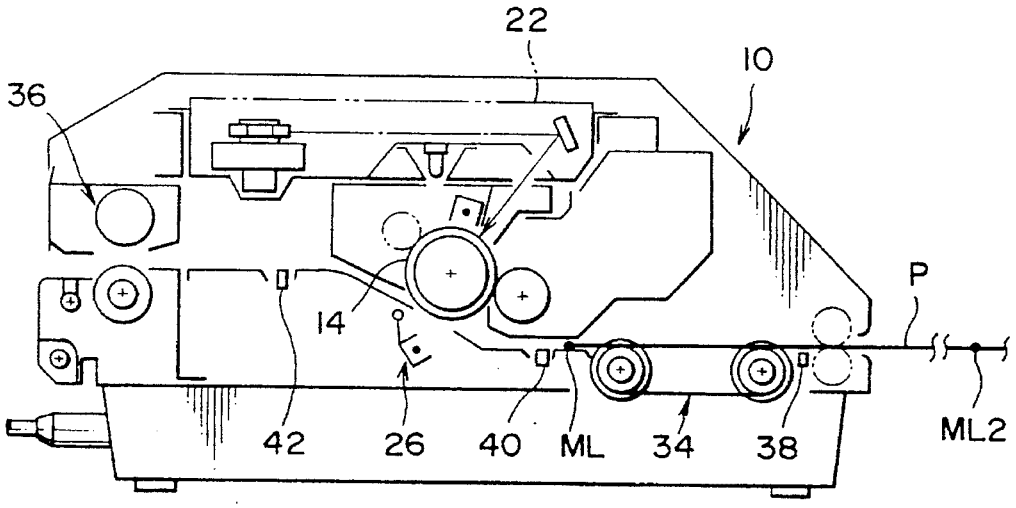
Figure 6:
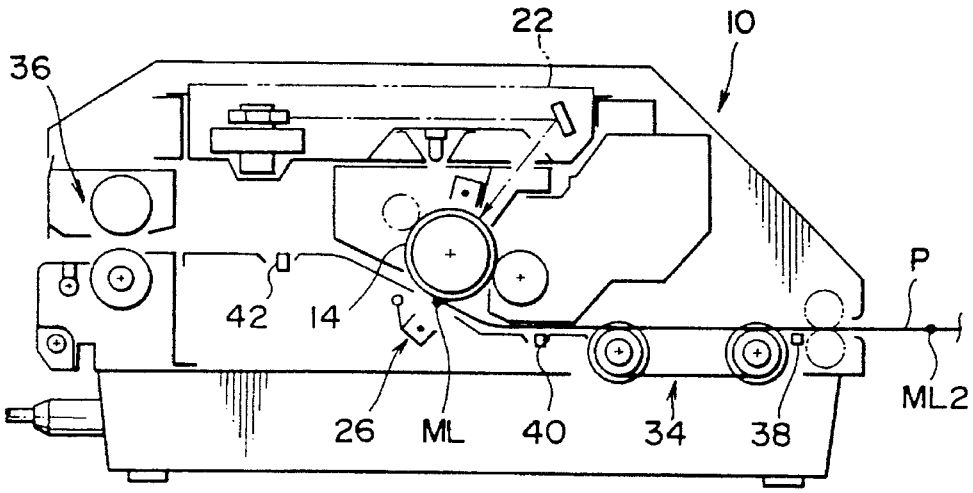

If the sheet P is not detected at sensor F (S12), but is detected at sensor P (S10), then the sheet P is in the loaded position shown in Fig. 5, and the control flow passes to the branch shown at step S16. At S16, the tractor 34 is driven until the sheet leading edge ML is detected by sensor F (S18). At this point, the encoder pulse counter C is reset to zero (S20), the tractor continues to advance, and the encoder pulse counter is incremented for every pulse detected (S22) until the pulse counter reaches a number L (S24) which corresponds to the distance between sensor F (sheet detector 40) and the transfer region, as shown in FIG. 6. The sheet feed is controlled at every stage of operation, based upon the pulse data from the encoder 34*h* and the photo-interrupter 34*i*. The leading edge ML of the sheet is thus precisely positioned in the transfer region, and the control flow passes back to the main branch at S26, where the tractor is stopped at the print waiting position.

When the feed status is checked at S10 and S12, if the controller has already advanced the sheet P at least to the second sheet detector 40 in the entry path 30, then the sheet feed mode is checked at S28. If the retraction (third) feed mode is not selected, then the sheet will not be retracted, and the control flow skips the retraction steps S32, S34, S36, S38 and proceeds to the tractor stop (S26) at 25 the print waiting position.

If the retraction (third) mode is detected in the mode check at S28, sensor R (sheet detector 42 in the discharge path 32) is then checked at S30. If a sheet in the discharge path 32 is not detected by sensor R (S30), then retraction is unnecessary. The retraction steps S32, S34, S36, S38 are skipped, and the control flow proceeds to the tractor stop (S26) at the print waiting position.

If the retraction (third) mode is detected at S28, and sensor R detects a sheet in the discharge path at S30, then the sheet must be retracted, and the control flow proceeds to S32, where the tractor is reversely driven. The encoder pulse counter C is then reset to zero at S34, and the pulse counter C is incremented for every pulse detested (S36), until the pulse counter C reaches a number PC (S38) corresponding to the length of one discrete page of the sheet P. In this embodiment, since the retraction step follows a later described sheet advance of one discrete page length, the retraction length is set to be one discrete page length. When one discrete page has been retracted and the encoder pulse counter C reaches PC at S38, the control flow proceeds to S26, and the tractor 34 is stopped with a leading edge ML of the sheet P at the print waiting position.

The number of pulses PC corresponding to one discrete page of the employed sheet P is set in accordance with the sheet size input, set through the operation panel 122 or the host computer 128, and stored in the memory 126. For example, in the present embodiment, the slits of the encoder 34*h* are formed at an interval corresponding to the ½ inch interval of both the protrusions formed on the tractor belt 34*a* and the sprocket holes in fan-fold sheet P. PC may be set at 22 pulses for 11 inch discrete page size, 24 pulses for 12 inch etc. The printer may thereby employ various fan-fold paper of different discrete page sizes.

After the sheet P is positioned at the print waiting position (S26 tractor STOP) illustrated in FIG. 6, wherein the leading edge ML of the sheet P is positioned at the transfer charger 26, the imaging process is started. Rotation of the drum 14 and exposure by the laser scanning unit 22 are initiated at S40 and S42 respectively. Although not shown in the flow charts of FIGS. 3 or 4, operations of the toner cleaning unit 16, the decharging unit 18, the charging unit 20, and the developing unit 24 are initiated along with the initiation of the rotation of the drum 14.

Following the initiation of the laser scanning unit 22 operation at S42, the tractor 34 advances the sheet P along the sheet feed path (S44), such that the leading edge of the toner image carried by the drum 14 coincides with the leading edge of the first page printing area of the sheet P at the transfer charger 26. The transfer charger 26 is simultaneosly moved to its operating position and transfer of the image is initiated (S46).

Figure 4:
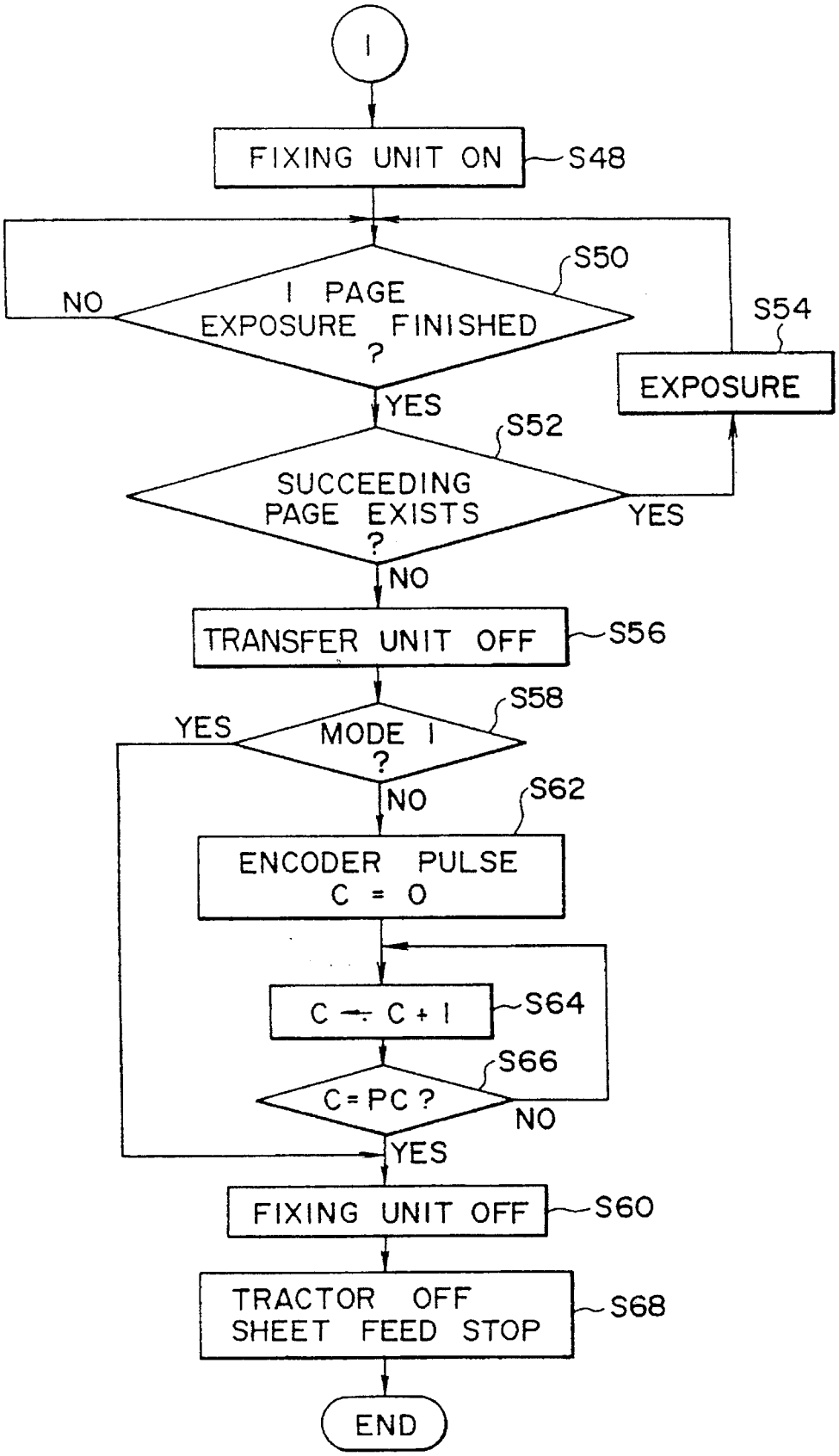

Continuing the flow chart in FIG. 4, the fixing operation of the fixing unit 36 is then initiated at S48. Thus, the toner image formed on the drum 14 is transferred onto the sheet P and fixed thereto.

At the conclusion of the exposure of one page (S50), a check for a succeeding page is performed (S52), and exposure operations and the associated functions are continued (S54) until the succeeding page check at S52 determines that there are no further succeeding pages to be exposed.

If there are no further succeeding pages detected at S52, when the final image bearing page is clear of the drum 14 and transfer charger 26, the rotation of the drum 14 and the transfer operation are ceased. The transfer charger is then retracted to its inoperative position at S56.

A mode check is then performed (S58). If the first sheet feeding mode is selected, paper advance is not required, and the control flow skips the paper advance steps S62, S64, S66 and proceeds to fixing unit STOP step S60. The fixing operation is stopped and the heat roller is retracted to the inoperative position (S60). The tractor feed is also stopped (S68) and a portion of the sheet P carrying an unfixed image remains inside the printer body 120.

If the second or third sheet modes are selected at the time of sheet feed mode check S58, the sheet continues for one additional page length (PC pulses) at S62, S64 and S66. The sheet proceeds to the position shown in FIG. 7, wherein the printed portion of the sheet P is entirely outside the printer body 120, and the sheet P has been fed one additional page length past the transfer region. The fixing operation is then stopped and the fixing roller retracted at S60, and the drum rotation subsequently stopped and the transfer charger retracted at S68.

Figure 7:
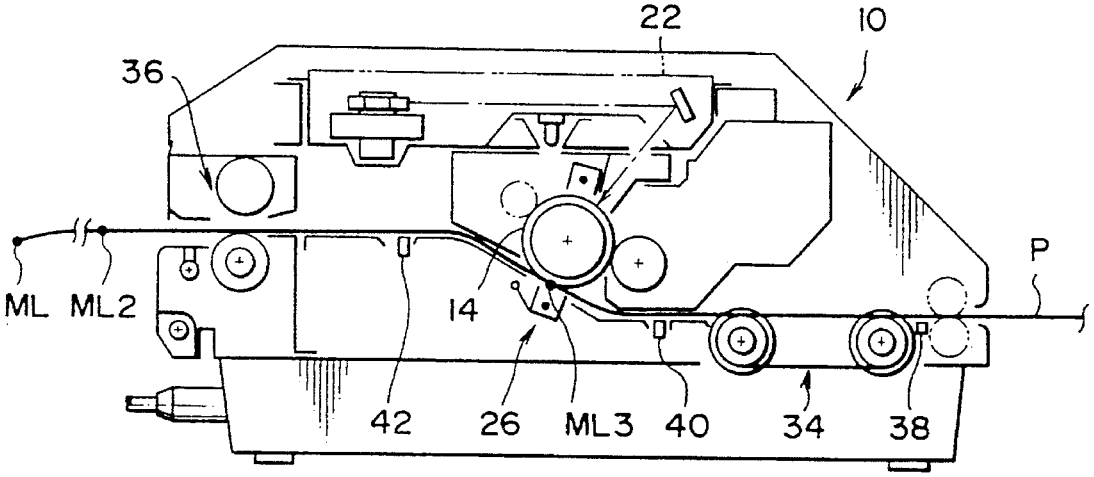

Thus, if the second or third sheet feeding modes are selected, when the image transfer is complete at S56, the trailing edge of the final image bearing page of the sheet P and the leading edge ML2 of the next blank page are positioned at the print waiting position. In this embodiment, since the distance between the image transfer position and the sheet discharge port 12*b* is lees than a minimum page length of a fan-fold sheet, if the sheet is advanced by one sheet length (PC pulses) following the image transfer, then the leading edge ML2. of the next blank page will clear the printer body 120 as shown in FIG. 7. The final image bearing page of the sheet P, with the image fixed thereto by the fixing unit 36, is therefore clear of the printer body 120 and may be separated at the discrete page perforations at ML2.

Figure 8:
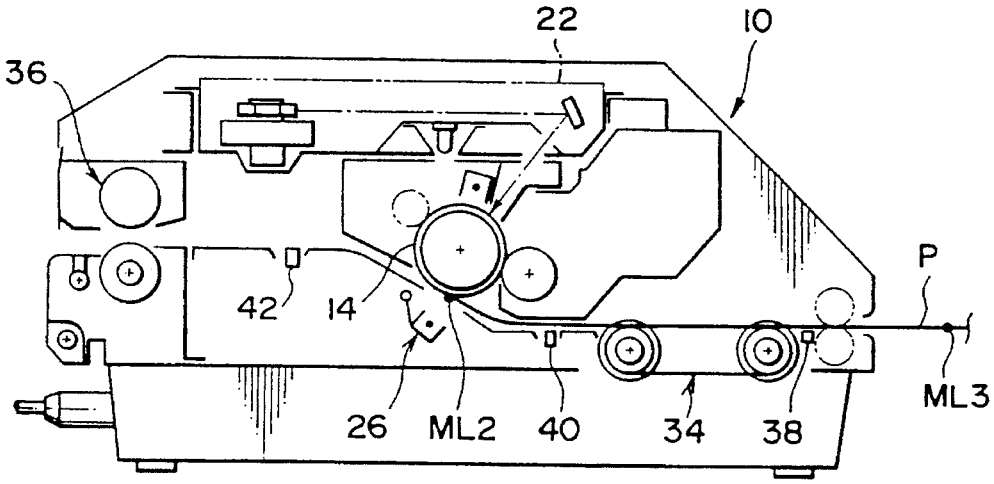

If the retraction (third) feed mode is selected (checked at S28, FIG. 3A), the sheet P will stand-by in the discharged position, and upon the beginning of transmission of the next set of print data, the sheet P will be retracted by one page length (PC pulses) at S32, S34, S36, and S38. When the sheet is retracted, the leading edge ML2 of the succeeding blank page of the sheet P is positioned at the print waiting position (FIG. 8). In this case, if the image bearing page of the sheet P has not been separated, it will be returned into the printer body 120. However, the image will have been fixed to the sheet P, and the return of the fixed page into the printer body 120 is not problematic.

As described, a user may change upon demand, the sheet feeding mode of a laser beam printer employing a sheet feeding mechanism embodying the invention. More particularly, even when there are pauses in the transmission of printing data from the host computer, printing operation may be continuously executed depending on the mode selected. Furthermore, when the second or third modes are selected, the fixed image bearing page of the sheet P is discharged from the printer body following printing, allowing easy separation of the printed pages. If the third mode is selected, when the transmission of a next set of printing data is received, a succeeding blank page that has been advanced to allow page separation is retracted into the printer body to prevent paper wasting. Since the distance between the image transfer position and the image fixing position is less than a minimum page length of a fan-fold sheet, the adjustment of operation for various page sizes of fan-fold sheet can be set without mechanical adjustment, and the printer may therefore be made more compact.

The present disclosure relates to a subject matter contained in Japanese Patent Application No. HEI 5-186810, filed on Jun. 30, 1993, which is expressly incorporated herein in its entirety.

What is claimed is:

1. In an electrophotographic printer for printing an image onto a continuous sheet, a sheet feed mechanism comprising:

means for defining a sheet path;

a feeding device for advancing a printed portion of said continuous sheet to discharge said printed portion of said continuous sheet from said printer and for retracting said continuous sheet into said printer along said sheet path;

means for checking if a successive page of image data to be printed, after said printed portion, is available to be printed;

means for controlling said feeding device to advance said printed portion of said continuous sheet to discharge from said printer in response to said checking means indicating that said successive page of image data is not available to be printed; and means for prohibiting said advancing of said printed portion of said continuous sheet to discharge from said printed even when a successive page of image data to be printed is not available, whereby said prohibiting means prohibits advancement of said printed portion if said checking means indicates that said successive page of image data to be printed is not available due to a pause in transmission of image data.

2. The sheet feed mechanism according to claim 1, wherein said image on said discharged portion of said continuous sheet is a fixed image.

3. The sheet feed mechanism according to claim 1, further comprising:

said means for controlling including means for stopping said printed portion of said continuous sheet when said printed portion is discharged from said printer body, and retracting said continuous sheet into said printer body to a position to print an image to a blank portion of said continuous sheet when a successive page of image data to be printed is not available; and means for preventing said stopping and said retracting, even when a successive page of image data to be printed is not available, whereby if said checking means indicates a lack of said successive page due to a transmission delay of printing data, said preventing means prohibits advancing of said printed portion of said continuous sheet to discharge from said printer.

4. The sheet feed mechanism according to claim 3, wherein said image on said discharged portion of said continuous sheet is fixed image.

5. The sheet feed mechanism according to claim 1, wherein said feeding device is a tractor unit having a tractor belt, said tractor belt engaging sprocket holes in said continuous sheet in order to advance and retract said continuous sheet.

6. The sheet feed mechanism according to claim 3, further comprising:

a selector disposed on an operating panel of said electrophotographic printer, said selector controlling said means for prohibiting and said means for preventing.

7. The sheet feed mechanism according to claim 6, wherein said selector further comprises:

a rewritable memory for storing information representing states of said means for preventing and said means for prohibiting;

means for changing said information in said rewritable memory; and means for activating said means for preventing and said means for prohibiting, said activating means being capable of reading from said rewritable memory, and of activating said preventing means and prohibiting means, based on said information in said rewritable memory.

8. The sheet feed mechanism according to claim 7, wherein said means for changing said information in said rewritable memory is a switch disposed on an operating panel of said imaging device.

9. The sheet feed mechanism according to claim 7, wherein said means for changing said information in said rewritable memory is a host computer capable of sending information to said rewritable memory.

10. The sheet feed mechanism according to claim 1, wherein said sheet feed path comprises an image transfer region and an image fixing region; and a distance between said image transfer region and said image fixing region of said sheet feed path is less than a shortest discrete page length of a continuous sheet employable in said electrophotographic printer.

11. The sheet feed mechanism according to claim 1, further comprising:

a sheet feed amount measuring device for measuring a sheet feed distance amount for both forward and reverse feeds;

a rewritable memory, for storing information representing predetermined discrete page lengths of a continuous sheet, each said discrete page length corresponding to an amount of sheet feed to be measured by said sheet feed measuring device; wherein said sheet feed path comprises an image transfer region and an image fixing region, said image fixing region positioned in a forward feed direction with respect to said image transfer region along said sheet feed path;

a distance between said image transfer region and said image fixing region along said sheet feed path is less than a shortest discrete page length of possible discrete page lengths of a continuous sheet employable in said electrophotographic printer; and said means for controlling said feeding device to advance said printed portion of said continuous sheet controls said feeding device based on the measurements of said sheet feed measuring device and on said information representing said predetermined discrete page lengths stored in said rewritable memory.

* * * * *

UNITED STATES PATENT AND TRADEMARK OFFICE

CERTIFICATE OF CORRECTION

PATENT NO. : 5,532,811

DATED : July 2, 1996

INVENTOR(S) : T. NISHIKAWA et al.

It is certified that error appears in the above-indentified patent and that said Letters Patent is hereby corrected as shown below:

At column 6, line 63 (claim 1, line 20), change "printed" to ---printer---.

Signed and Sealed this

Seventh Day of January, 1997

*Attest:*

Bruce Lehman

BRUCE LEHMAN

*Attesting Officer*

*Commissioner of Patents and Trademarks*